United States Patent [19]

Viletto

[11] 4,261,114

[45] Apr. 14, 1981

[54] SKI BOOT AND SOLE PLATE

[76] Inventor: Felix A. Viletto, 116 Ford City Rd., Freeport, Pa. 16229

[21] Appl. No.: 111,462

[22] Filed: Jan. 11, 1980

[51] Int. Cl.[3] ..... A43B 5/04

[52] U.S. Cl. ..... 36/120; 36/132

[58] Field of Search ..... 36/117, 118, 119, 120, 36/121, 132

[56] References Cited

U.S. PATENT DOCUMENTS

| | | | |
|---|---|---|---|
| 3,535,800 | 10/1970 | Stohr | 36/120 |
| 3,852,896 | 12/1974 | Rizel et al. | 36/120 |
| 4,186,500 | 2/1980 | Salzman | 36/117 |

*Primary Examiner*—Patrick D. Lawson

*Attorney, Agent, or Firm*—Harvey B. Jacobson

[57] ABSTRACT

A ski boot is provided including a lower sole portion and an upper boot portion supported from and secured to the lower sole portion. The upper boot portion is constructed of stiff material, but includes transverse corrugations extending forwardly and upwardly along opposite sides of the upper and across the instep portion thereof. The corrugations enable forward flexing of the upper portion of the upper boot portion as required to enable a skier to bend his knees and to lean forwardly, and the sole portion is substantially rigid, except in the portion thereof underlying the area of the boot in which the ball of the associated foot is to be received. This portion of the sole is flexible to enable localized flexing of the sole when walking and an attachment is provided therefor operable to selectively render the entire sole substantially inflexible, the attachment being worn while skiing.

10 Claims, 6 Drawing Figures

SKI BOOT AND SOLE PLATE

BACKGROUND OF THE INVENTION

It has been found that reasonably stiff ski boot uppers and substantially nonbendable ski boot soles are required for skiing, except that the upper portion of the boot upper must be capable of being flexed forwardly and downwardly to accommodate the bending of the knees of the associated skier and the lower leg portions of the skier being forwardly and upwardly inclined relative to his feet.

Numerous manufacturers of ski boots have attempted to provide boot uppers which are stiff and do not flex, except in a direction to displace the upper portions of the uppers forwardly and downwardly as required. However, ski boots of this type are extremely difficult to walk in and accordingly a need exists for a ski boot upper and sole portion which is sufficiently stiff for proper support during skiing but which may be utilized in a conventional manner when walking.

Examples of previously known forms of ski boots including some of the general structural and operational features of the instant invention are disclosed in U.S. Pat. Nos. 1,440,565; 3,597,862; 3,677,567; 3,694,937; 3,732,635; 3,775,875 and 3,924,869.

However, these previously known forms of ski boots are not capable of functioning, efficiently, when skiing as a stiff and supportive ski boot and also when walking as a ski boot which is sufficiently flexible to enable walking in the conventional manner.

BRIEF DESCRIPTION OF THE INVENTION

The ski boot of the instant invention includes a sole which is rigid throughout substantially its entire length, except in the portion of the sole positioned to underlie the ball of the associated foot. In this sole portion, the sole is flexible, but the ski boot includes an attachment therefor which may be applied to the ski boot in order to render the entire sole inflexible.

The ski boot upper is constructed of stiff material, but includes specifically oriented corrugations extending forwardly and upwardly along opposite sides of the boot and across the instep portion thereof. These corrugations enable the otherwise stiff boot upper to flex in the manner required when the associated skier bends his knees and leans forwardly.

The main object of this invention is to provide a ski boot which will afford ample support to the skier's foot and ankle when skiing and yet which will enable the skier to walk in a substantially conventional manner.

Another object of this invention is to provide an improved ski boot construction whose features are to provide flexibility for bending in a specific manner and enable the boot upper to be constructed of various substantially stiff materials heretofore excluded from use in the manufacture of ski boots due to their excess stiffness.

Another important object of this invention is to provide a ski boot constructed in a manner to afford maximum stiffness, and yet desired flexibility, while skiing and yet which will enable substantially unencumbered walking.

A final object of this invention to be specifically enumerated herein is to provide an improved ski boot in accordnace with the preceding objects and which may conform to conventional forms of manufacture, be of simple construction and effecient in operation, so as to provide a device that will be economically feasible, long lasting and capable of performing as intended.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
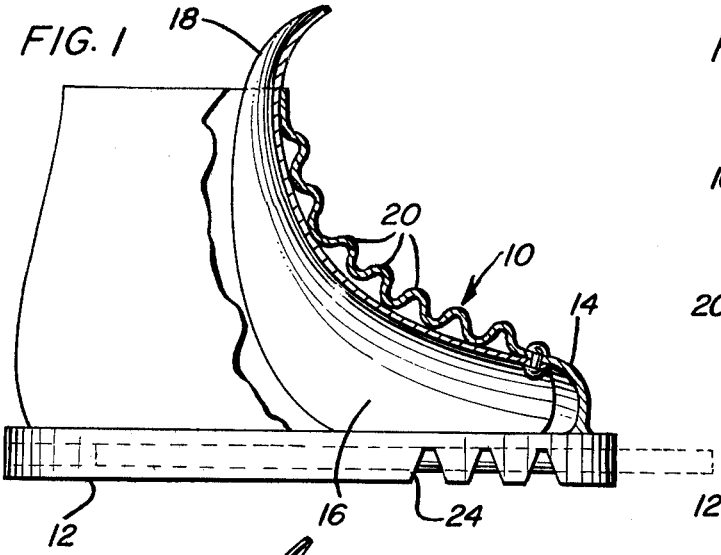
FIG. 1 is a side elevational view of a ski boot constructed in accordance with the present invention with a portion of the boot upper being broken away and illustrated in vertical section.
Figure 2:
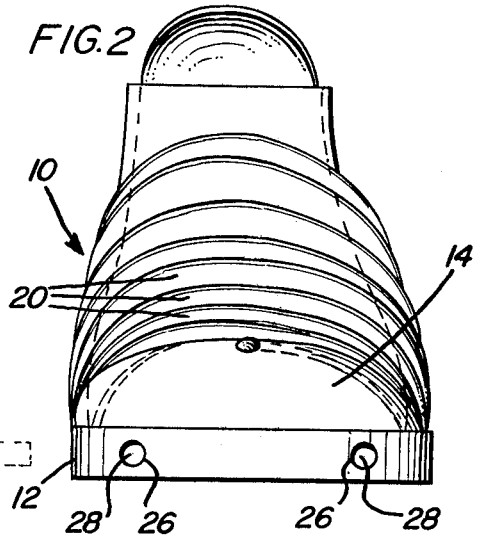
FIG. 2 is a front elevational view of the boot.

Referring now more specifically to the drawings, the numeral 10 generally designates a first form of ski boot constructed in accordance with the present invention. The ski boot 10 includes an elongated horizontal sole 12 constructed of substantially stiff material. In addition, the ski boot 10 includes an upper 14 also constructed of substantially stiff material, but which includes a substantially full width flexible tongue 16 including an upper end 18 projecting above the upper forward portion of the upper 14. Also, it may be seen from FIGS. 2 and 3 of the drawings that the upper 14 includes elongated laterally spaced corrugations 20 extending in forwardly and upwardly inclined directions on opposite sides of the upper 14 and across the instep portion of the upper 14. The corrugations 20, therefore, extend forwardly and upwardly along one side of the upper, across the instep portion and then downwardly and rearwardly along the other side of the upper. The corrugations 20 enable the top or upper portion 22 of the upper 14 to bend forwardly and downwardly as required when the user wishes to bend his knees and lean forwardly.

Also, the sole 12 includes three longitudinally spaced downwardly, opening transverse grooves 24 formed therein. The grooves 24 are formed in the portion of the sole 12 that underlies the ball of the foot of the user and, accordingly, the sole 12 is flexible only in the portion thereof having the grooves 24 formed therein. This flexible portion of the sole 12 enables the user to walk with boots 10 on his feet in a conventional manner. However, in order to assure sufficient stiffness of the sole 12 while skiing, the sole 12 includes longitudinally extending transversely spaced bores 26 formed therein and the bores 26 removably receive elongated stiffening rods 28 therein. The rods 28, when extending through the bores 26, bridge the grooves 24 and thus render the entire sole 12 substantially rigid. The substantially rigid sole, when the rods 28 are in position, and the stiff upper 14 including the corrugations 20 enabling the upper 14 to bend or flex only along the corrugations 20 assures extremely good support for the associated foot and ankle, and yet enables desired bending of the boot upper, independent of flexing of the sole portion 12, when skiing.

Figure 3:
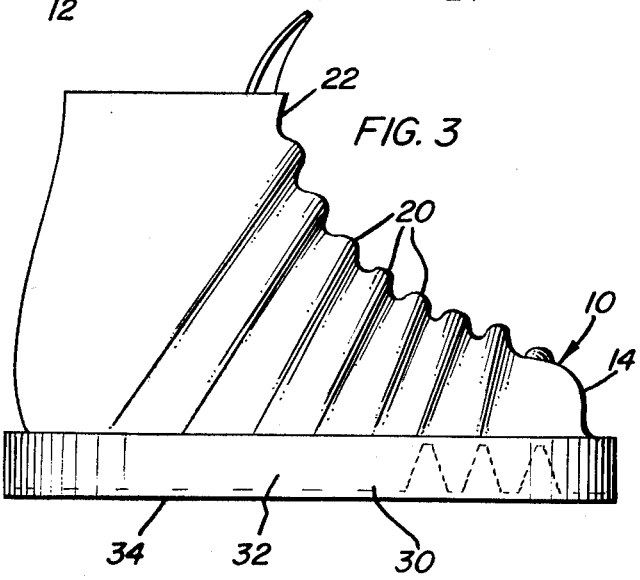
FIG. 3 is a side elevational view of the boot illustrating a second form of removable sole stiffening attachment utilized in conjunction therewith.
Figure 4:
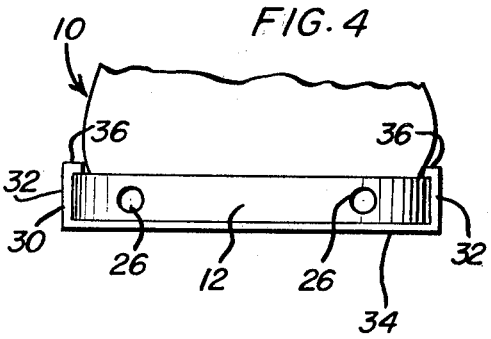
FIG. 4 is a fragmentary front elevational view of the ski boot issustrated in FIG. 3.

With attention now invited more specifically to FIGS. 3 and 4 of the drawings, the boot 10, instead of being provided with the rods 28, is provided with a wide shallow channel-shaped stiffening member 30 which may be applied to the sole 12 in lieu of the rods 28 in order to insure rendering the sole 12 substantially rigid. The stiffening member 30 includes a pair of substantially parallel upstanding opposite side flanges 32 interconnected along their lower marginal portions by a horizontal bight portion 34 and the upper ends of the flanges 32 includes inwardly directed retaining flange portions 36 for overlapping the upper surface of the corresponding longitudinal opposite side edges of the sole 12. Of course, the opposite side edges of the sole 12 are substantially parallel to enable the stiffening member 30 to be slidingly engaged therewith.

Figure 5:
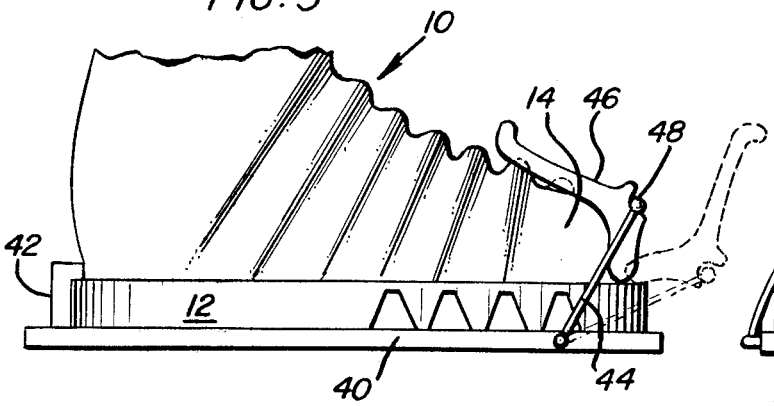
FIG. 5 is a side elevational view of a ski boot utilizing a third form of removable sole stiffening attachment.
Figure 6:
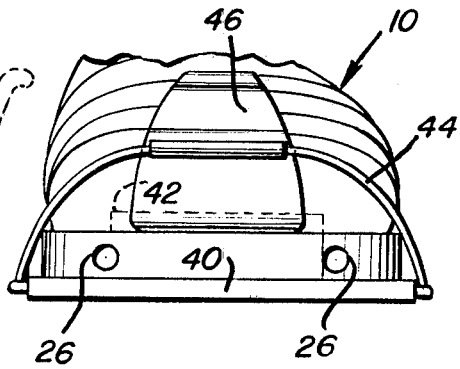
FIG. 6 is a fragmentary front elevational view of the boot illistrated in FIG. 5.

With attention now invited more specifically to FIGS. 5 and 6 of the drawings, it may be seen that the sole 12 of the boot 10 is stiffened through the utilization of a sole plate 40 including an upper inverted L-shaped flange 42 for engagement over the rear end of the sole 12 and a forward pivoted bail 44 and formed latching toggle 46 oscillatably supported from the bail 44 as at 48. The toggle 46 is contoured to closely embrace the forward toe portion of the upper 14 and to clamp downwardly on the sole forward end. The toggle 46 may be readily swung pass an over-center position from the solid line position illustrated in FIG. 5 to the phantom line position of FIG. 5 in order to release the sole plate 40 from locked engagement with the sole 12.

From the foregoing, it may be seen that the ski boot 10 includes a sole portion which is flexible only in the area thereof to underlie the ball of the associated foot and which may have a sole stiffening attachment operatively associated therewith for rendering the sole substantially rigid. In additon, the boot 10 includes an upper constructed of stiff material, but including corrugations 20 which enable flexing of the boot upper 14 in a manner to accommodate bending of the user's knees and the user inclinging his lower leg portions forwardly and upwardly relative to the associated sole portions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A ski boot including a lower sole portion and an upper boot portion supported from and anchored to the lower sole portion, said boot portion including a forward lower portion for receiving the ball of the user's foot therein, said sole portion, exclusive of the area thereof underlying said forward lower portion, being stiff and substantive non-flexive under normal walking stresses and said area of said sole portion including means rendering said area reasonably flexive for relative angular displacement of the front and rear sole portions forward and rearward of said area about a transverse bending zone to flexed positions with said front and rear sole portions defining and upwardly opening included angle of less than 180°, and an attachment releasably mountable from said sole portion and engaged with said front and rear sole portions rigidifying said sole portion and preventing flexure thereof from a generally longitudinally straight condition to said flexed positions.

2. The combination of claim 1 wherein said sole portion includes at least one longitudinal bore formed therein and extending at least substantially the full length of said sole portion and opening endwise outwardly of the corresponding sole end, said attachment including an elongated stiffening rod removably received in said bore and spanning between said front and rear portions.

3. The combination of claim 1 wherein said sole portion includes a pair of said bores and said attachment includes a pair of said stiffening rods.

4. The combination of claim 1 wherein said attachment includes a shallow channel member of greater width than height and including upstanding opposite side longitudinal flanges terminating upwardly in inturned flanges, said channel member being longitudinally slidingly engaged with said sole portion from one end thereof with said inturned flanges overlying upper surfaces of opposite side marginal portions of said lower sole portion.

5. The combination of claim 1 wherein said attachment includes an elongated rigid plate positionable under said sole portion and including a rear upstanding abutment having a forwardly directed upper end portion for overlying the upper surface of the rear end of said sole portion, the forward end of said plate including a pivoted bail supported over center moveable toggle removably downwardly clamped upon the upper surface of the front end of said sole portion.

6. A ski boot including a lower sole portion and an upper boot portion supported from and anchored to the lower sole portion, said boot portion including a forward lower portion for receiving the ball of the user's foot therein, said sole portion being stiff and substantially non-flexible, said upper boot portion being constructed of stiff material for lateral bracing of the associated ankle, said upper boot portion including laterally spaced generally parallel corrugations formed therein extending forwardly and upwardly from said sole portion on opposite sides of said upper boot portion and spaced intermediate the opposite ends of said upper boot portion, corresponding corrugations on opposite sides of said upper boot portion being jointed by coextensive upper laterally spaced and transversely extending corrugated zones formed in said upper boot portion extending across the instep portion of said upper boot portion, said corrugations and corrugated zones rendering said upper boot portion flexible to the extent that the upper extremity of said upper boot portion may be flexed forwardly and downwardly relative to the toe area of said upper boot portion.

7. The combination of claim 6 wherein said sole portion, exclusive of the area thereof underlying said forward lower portion, is stiff and substantive non-flexive under normal walking stresses and said area of said sole portion including means rendering said area reasonably flexive for relative angular displacement of the front and rear sole portions forward and rearward of said area about a transverse bending zone to flexed positions with said front and rear sole portions defining an upwardly opening included angle of less than 180°, and an attachment releasably mountable from said sole portion and engaged with said front and rear sole portions rigidifying said sole portion and preventing flexure thereof from a generally longitudinally straight condition to said flexed positions.

8. The combination of claim 7 wherein said sole portion includes at least one longitudinal bore formed therein and extending at least substantially the full length of said sole portion and opening endwise outwardly of the corresponding sole end, said attachment including an elongated stiffening rod removably received in said bore and spanning between said front and rear portions.

9. The combination of claim 7 wherein said attachment includes a shallow channel member of greater width than height and including upstanding opposite side longitudinal flanges terminating upwardly in inturned flanges, said channel member being longitudinally slidingly engaged with said sole portion from one end thereof with said inturned flanges overlying upper surfaces of opposite side marginal portions of said lower sole portion.

10. The combination of claim 7 wherein said attachment includes an elongated rigid plate positionable under said sole portion and including a rear upstanding abutment having a forwardly directed upper end portion for overlying the upper surface of the rear end of said sole portion, the forward end of said plate including a pivoted bail supported over center moveable toggle removably downwardly clamped upon the upper surface of the front end of said sole portion.

* * * * *